US005584624A

United States Patent [19]

DeVoursney

[11] Patent Number: 5,584,624

[45] Date of Patent: Dec. 17, 1996

[54] DUNNAGE RACK BAR

[75] Inventor: Thomas F. DeVoursney, Muskegon, Mich.

[73] Assignee: Shape Corp., Grand Haven, Mich.

[21] Appl. No.: 386,430

[22] Filed: Feb. 10, 1995

[51] Int. Cl.[6] ..... B60P 7/00; B61D 45/00

[52] U.S. Cl. ..... 410/143; 211/162; 211/182; 211/183; 428/586; 428/591

[58] Field of Search ..... 211/94, 94.5, 162, 211/182, 183; 428/586, 591, 603; 410/143–152

[56] References Cited

U.S. PATENT DOCUMENTS

| | | | |
|---|---|---|---|
| 2,603,167 | 7/1952 | Webster et al. | 410/152 |
| 2,990,037 | 6/1961 | Fowles | 211/182 X |
| 3,346,909 | 10/1967 | Blackburn | 211/162 X |
| 3,999,875 | 12/1976 | Simon | 403/186 |
| 4,238,550 | 12/1980 | Burgess et al. | 428/586 |
| 4,720,222 | 1/1988 | Nagy et al. | 410/151 |
| 5,012,938 | 5/1991 | King | 211/191 |
| 5,076,442 | 12/1991 | Hakeem | 211/94 X |
| 5,141,114 | 8/1992 | Cate, Jr. et al. | 211/162 X |
| 5,326,204 | 7/1994 | Carlson | 410/143 |

*Primary Examiner*—Alvin C. Chin-Shue
*Assistant Examiner*—Brian J. Hamilla
*Attorney, Agent, or Firm*—Warner Norcross & Judd

[57] ABSTRACT

Specification discloses a dunnage bar for a dunnage rack of the type used to store and transport parts within an automotive factory. The dunnage bar includes an outer C-shaped bar and an inner T-shaped bar both roll-formed from structural metal. The inner bar is closely received within and spot-welded to the outer bar. The stem of the inner bar engages the outer bar opposite the mouth and includes spaced webs permitting a welding fixture to be inserted through the mouth and between the webs. The cross arms of the inner bar also engage the outer bar and include spacer webs at their terminal edges to space the inner bar from the mouth of the outer bar.

15 Claims, 4 Drawing Sheets

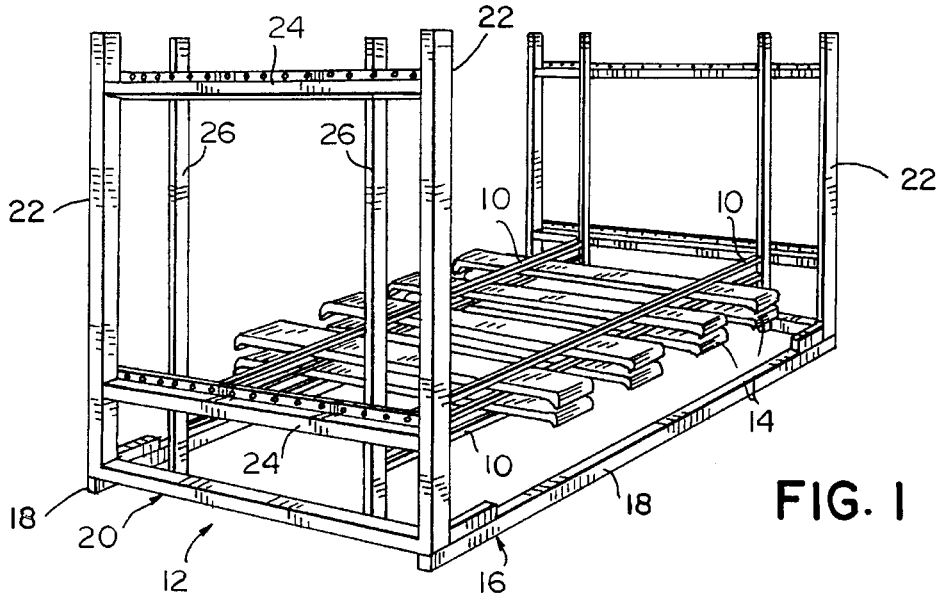
FIG. 1
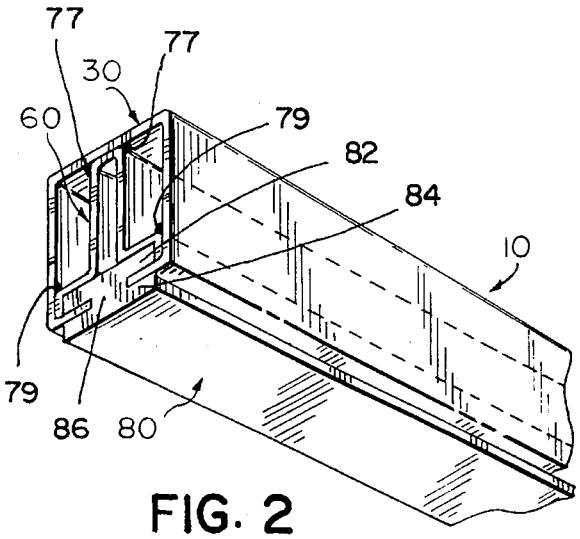
FIG. 2
FIG. 3
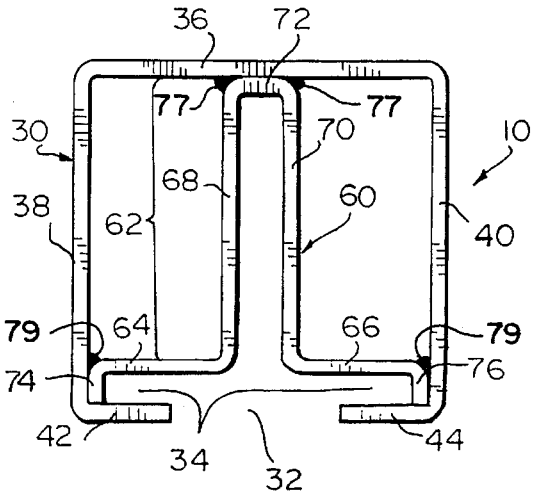

30

DUNNAGE RACK BAR

BACKGROUND OF THE INVENTION

The present invention relates to dunnage racks used to store and transport parts, such as automotive parts, and more particularly to a bar used in such racks.

Dunnage racks are widely used in manufacturing to store and transport parts, for example, automotive parts. These racks include a frame and a plurality of horizontal bars supported on the frame. Modular connectors permit the hanger bars to be spaced and positioned in a wide variety of configurations to accommodate different parts to be stored in the rack. A plastic and/or foam insert, generally well known to those having skill in the art, typically is mounted within each bar to engagingly support the parts.

Known dunnage bars are basically of two constructions. A first is extruded of aluminum and includes a T-shaped slot within which the insert is retained. These aluminum bars are relatively expensive. Further, the bars are subject to considerable pilferage because of their value as scrap aluminum.

A second is fabricated of two roll-formed pieces as illustrated in FIG. 7. The outer piece 110 is generally C-shaped including three closed planar sides 111, 112, and 113 and a fourth side 114 defining a mouth 115. The inner piece 120 is generally trough-shaped and located just behind the mouth 115. The two pieces are spot-welded together at spaced locations 130 to intersecure the pieces. While this bar is less expensive than the extruded bar, it does not have the structural integrity required for automotive parts applications. Specifically, this bar bends when subjected to forces encountered during normal handling while supporting normal loads. Consequently, the bar has proven to be unacceptable.

SUMMARY OF THE INVENTION

The aforementioned problems are overcome by the present invention wherein a dunnage bar is fabricated of two interconnected roll-formed pieces having profiles that structurally complement one another to stand up to normal handling forces. The assembly includes an outer bar portion and an inner bar portion closely fitted within the outer bar portion. The outer bar is generally C-shaped, defining a mouth through one side. The inner bar portion provides at least three points of contact, two being in corners, between the two portions. Consequently, the inner piece is structurally maintained in position with respect to all four sides of the outer piece. Additionally, the two pieces are spot-welded together to further enhance their strength.

These and other objects, advantages, and features of the invention will be more readily understood and appreciated by reference to the detailed description of the preferred embodiment and the drawings.

BRIEF DESCRIPTION OF THE DRAWINGS

FIG. 1 is a perspective view of a dunnage rack incorporating the dunnage bar of the present invention;

FIG. 2 is a perspective view of a section of the dunnage bar;

FIG. 3 is an end elevational view of the dunnage bar;

Figure 7:
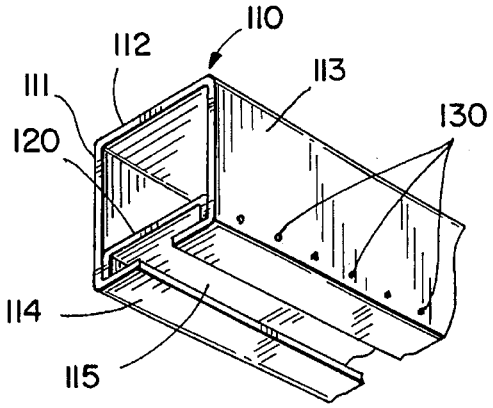
FIG. 7 (PRIOR ART)
Figure 6:
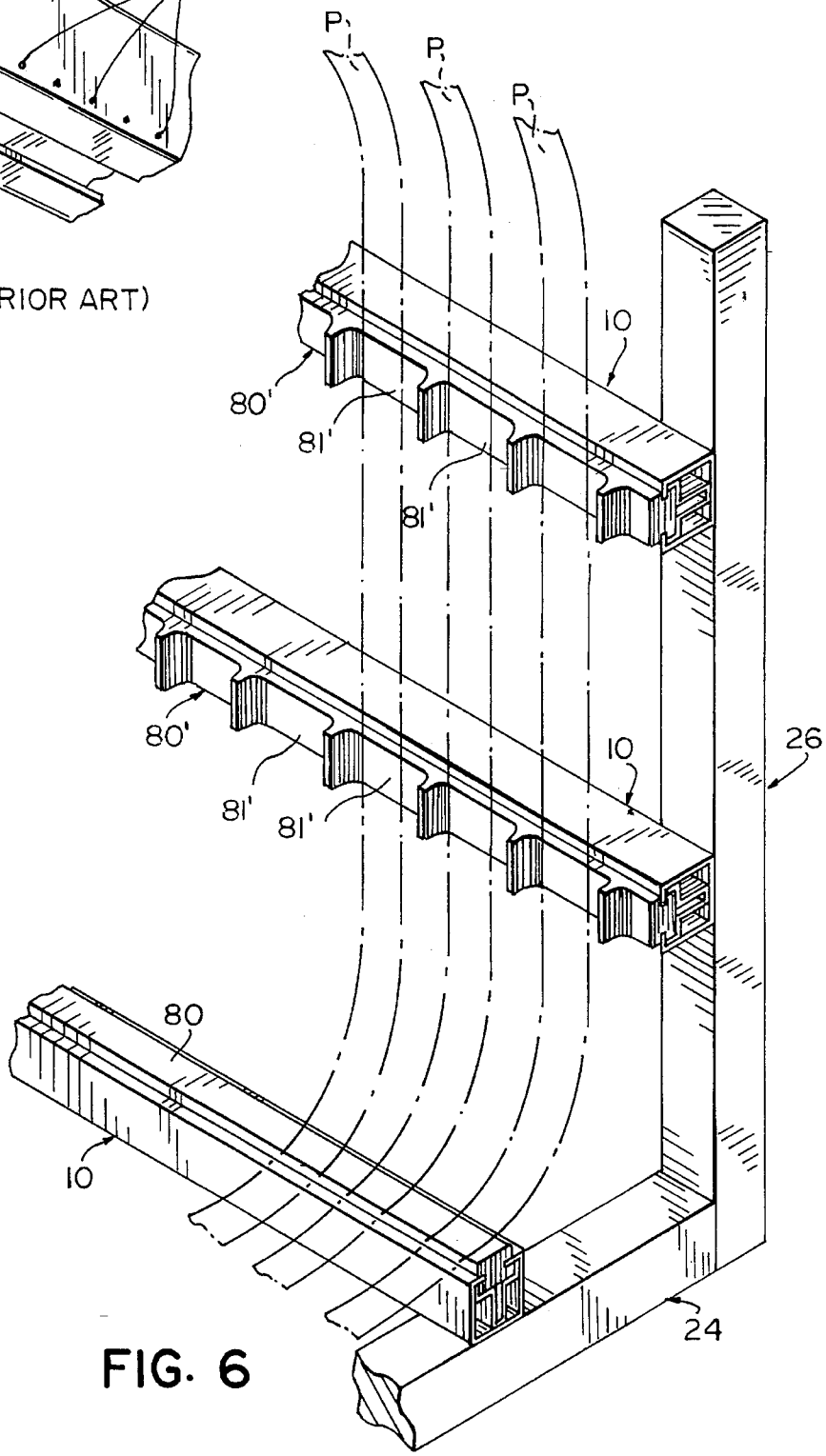

FIGS. *4a–4n* are flower designs illustrating the profile of the outer bar through the 14 stations of roll-forming;

FIGS. *5a–5n* are flower designs illustrating the profile of the inner bar through the 14 stations of roll-forming;

FIG. 6 is a perspective view of a dunnage rack wherein the dunnage bars include different inserts than shown in FIGS. 1 and 2 to support different parts; and FIG. 7 is a perspective view of a section of a prior art dunnage bar.

DETAILED DESCRIPTION OF THE PREFERRED EMBODIMENT

The dunnage bar of the present invention is illustrated in FIGS. 1–3 and generally designated 10. As illustrated in FIG. 1, a plurality of the dunnage bars 10 are mounted within and become a portion of a dunnage rack 12.

I. Dunnage Rack

With the exception of the dunnage bars 10, the dunnage rack 12 is generally known to those skilled in the art. For example, such dunnage racks are widely used in the automotive industry to store and transport parts, components, subassemblies, stampings, and the like within and between manufacturing facilities. As illustrated in FIG. 1, the dunnage rack 12 holds automobile bumpers 14.

The dunnage rack 12 includes a frame 16 including horizontal base members 18 and end frames 20. The end frame sections 20 in turn include a plurality of vertical uprights 22, horizontal supports 24 and vertical supports 26. As is known, the horizontal supports 24 and the vertical supports 26 can be interconnected in a variety of configurations on the vertical uprights 22. Also as is well-known, the dunnage bars 10 are mounted on the horizontal and/or vertical members 24 and 26 using conventional attachment hardware (not shown).

II. Dunnage Bar Inserts

The inserts 80 are generally well known and therefore will be briefly described. As best illustrated in FIG. 2, the insert is H-shaped including an inner retainer portion 82 located within the slot 34, an outer cushion portion 84 located outside the bar 10, and an interconnecting portion 86 located within the mouth 32. The inserts 80 are slid into the bars 10 to provide one cushioned side to the bar to engage the parts to be supported.

An alternative insert 80' is illustrated in FIG. 6 wherein the dunnage rack is configured to support parts P in closely spaced relationship. The alternative insert 80' is generally well known and includes a plurality of scallops or cups 81' along its length. One of the parts fits into each of the scallops or cups. Consequently, the parts P are spaced from one another.

III. Dunnage Bar

The dunnage bar 10 is illustrated in greater detail in FIGS. 2 and 3. The assembly includes an outer bar or piece 30 and an inner bar or piece 60. The outer bar 30 defines a mouth 32 through which plastic and/or foam inserts 80 extend to support parts within the rack. The outer and inner bars 30 and 60 together define a slot 34 located just above the mouth 32 within which the inserts 80 fit.

The outer bar 30 is generally C-shaped and includes three generally flat closed sides 36, 38, and 40. The sides 38 and 40 meet side 36 at bends. A pair of wall segments 42 and 44 extend inwardly toward one another from, and are connected to, the sides 38 and 40, respectively. These segments 42 and 44 stop short of meeting one another to define the mouth 32 through which, as mentioned above, the inserts 80 extend.

The inner bar 60 is generally T-shaped having a body portion 62 and a pair of cross arms 64 and 66. The body portion 62 includes a pair of spaced, generally flat, parallel side webs 68 and 70 interconnected by a byte web 72. Accordingly, the body portion 62 (or stem of the T-shape) is generally U-shaped. The byte web 72 contacts or engages the top 36 of the outer bar 30.

The cross webs 64 and 66 extend away from, and are connected to, the side webs 68 and 70, respectively. Each cross web 64 and 66 has a width sufficient to extend between the respective side web 68 and 70 and the side 38 or 40 of the outer bar 30. The cross webs 64 and 66 are generally co-planar and generally perpendicular to the webs 68 and 70. The cross arms 64 and 66 include spacer webs 74 and 76, respectively. The spacer webs are oriented generally perpendicularly to the cross webs 64 and 66 and space the cross webs 64 from the bottom segments 42 and 44 of the outer bar 30 to define the slot 34 therebetween.

Preferably, the outer bar 30 and the inner bar 60 are roll-formed of structural metal. In the presently preferred embodiment, that metal is 12-gauge, cold-rolled steel. Different materials having different gauges can be substituted depending upon the application. For example, other suitable materials include hot-rolled steel and high-strength steel.

Preferably, the byte web 72 of the inner bar 60 is welded to the side 36 of the outer bar 30 at welds 77. The spacing between the side webs 68 and 70 of the inner bar 30 accommodates projection welding. In the preferred embodiment, the two pieces are spot welded every 18 inches. Of course, other welding patterns, for example even including a continuous weld, could be used depending on the application.

Each of the spacer webs 74 and 76 is preferably welded to the sides 38 and 40, respectively, of the outer bar 30 at welds 79. In the presently preferred embodiment, these pieces are spot-welded at every 18 inches along the length of the bar assembly 10. Of course, other welding patterns, including a continuous weld line, can be used depending upon the application.

Welding serves two functions in the bar assembly 10. First, welding ensures that the two bars 30 and 60 will remain in locked position relative one another. Second, welding enhances the structural integrity of the bar assembly. It is currently envisioned that welding could be omitted in certain applications, and such a construction is anticipated to be within the scope of the present invention.

IV. Manufacture, Assembly, and Operation

Figures 4A, 4B, 4C, 4D, 4E, 4F, 4G, 4H, 4I, 4J, 4K, 4L, 4M, 4N:
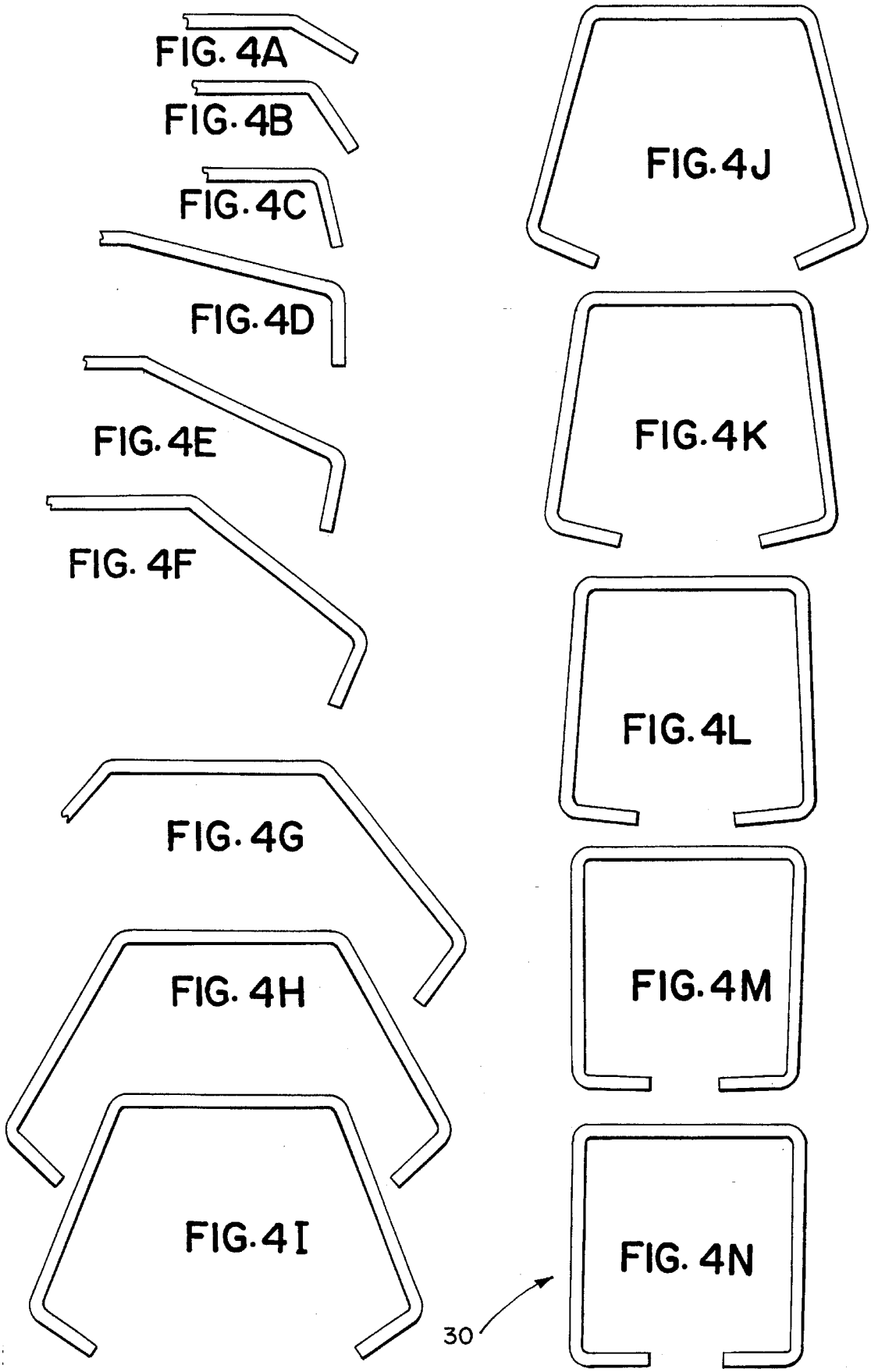
Figure 5K:
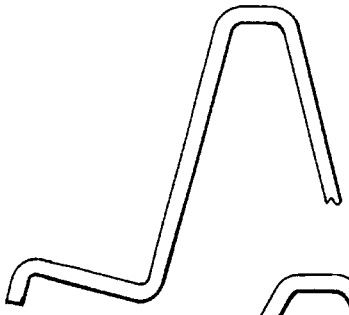
Figure 5J:
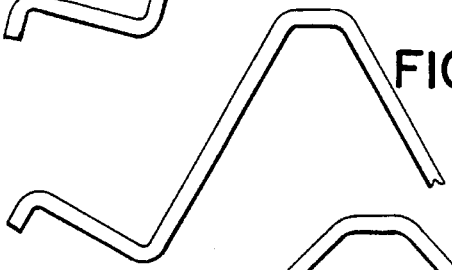
Figure 5I:
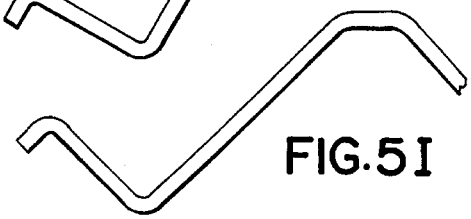
Figure 5H:
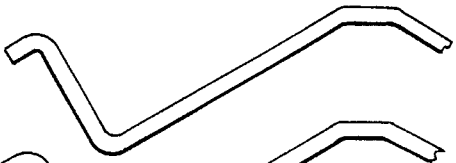
Figure 5G:
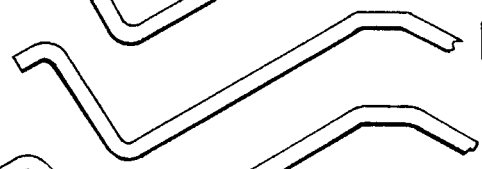
Figure 5F:
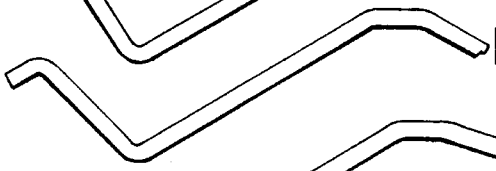
Figure 5E:
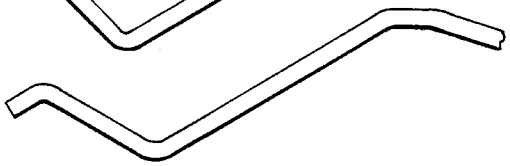
Figure 5D:
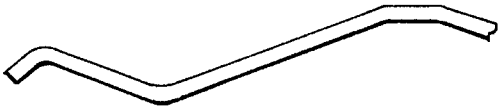
Figure 5C:
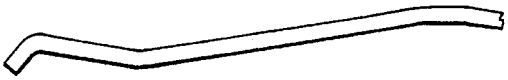
Figure 5B:
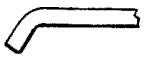
Figure 5A:
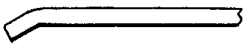
Figure 5L:
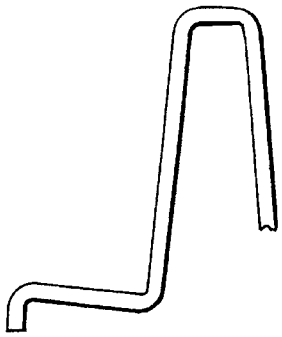
Figure 5M:
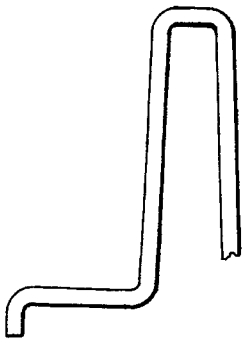
Figure 5N:
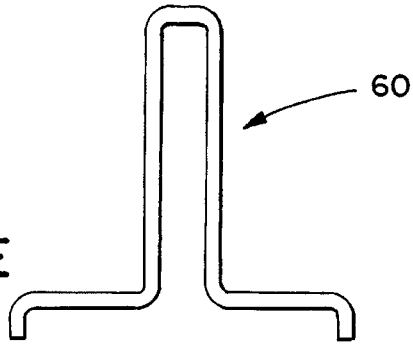

As noted above, the outer and inner bar portions 30 and 60 are roll-formed of a structural metal, preferably steel. The input stock to the rolling operation is 12-gauge hot-rolled steel. The shapes of the bar portions exiting each sequential roll-forming station are illustrated in FIGS. 4*a*–4*n* for the outer bar 30 and in FIGS. 5*a*–5*n* for the inner bar 60.

After the two bars 30 and 60 have been roll-formed, the inner bar 60 is slid into the outer bar 30. This step can be performed by hand or can be automated using hydraulic or pneumatic pressure. After the bars have been interfitted, they are welded. The spacing provided by the profile of the inner bar 60 permits welding fixtures to be positioned on both sides of the weldment locations.

The bar 10 of the present invention is used in the identical fashion as the prior art bars. The bars 10 are mounted between the opposite side frames 20 of the rack using conventional hanger hardware (not illustrated). Parts are supported by the inserts 80. Parts are secured in, and removed from, the dunnage rack in a fashion generally known to those skilled in the art.

The dunnage bar 10 of the present invention is a marked improvement in the art. First, the hanger bar has improved structural integrity. Second, the hanger bar is relatively inexpensive to manufacture. Third, the hanger bars are not a pilferage target in view of their relatively low scrap value.

The above description is that of a preferred embodiment of the invention. Various alternations and changes can be made without departing from the spirit and of broader aspects of the invention as defined in the appended claims, which are to be interpreted in accordance with the principals of patent law including the doctrine of equivalents.

The embodiments of the invention in which an exclusive property or privilege is claimed are defined as follows:

1. A dunnage rack dunnage bar comprising:

a one-piece C-shaped outer bar defining a mouth along its length;

a one-piece inner bar fitted within said outer bar, said inner bar including a body portion and a pair of cross webs, said cross webs extending from said body portion and away from one another, said body portion and each of said cross webs engaging said outer bar at mutually distinct locations to provide three-point transverse contact between said inner bar and said outer bar, each of said cross webs of said inner bar including an arm web and a spacer web extending from said arm web, both of said spacer webs engaging said outer bar and spacing said arm webs from said mouth.

2. A dunnage rack dunnage bar comprising:

a one-piece C-shaped outer bar including a pair of spaced wall segments defining a mouth along the length of said outer bar, said outer bar further including a closed side opposite said mouth;

a one-piece inner bar fitted within said outer bar, said inner bar including a body portion and a pair of cross webs extending away from one another and away from said body portion, each of said cross webs engaging one of said wall segments of said outer bar, said body portion engaging said closed side of said outer bar, whereby said body portion maintains each of said cross webs in engagement with said wail segments of said outer bar to provide three-point contact between said inner bar and said outer bar.

3. A dunnage bar as defined in claim 1 wherein said body portion of said inner bar includes a pair of spaced side webs interconnected by a bight web, said bight web engaging said outer bar.

4. A dunnage bar as defined in claim 1 wherein said inner bar is welded to said outer bar.

5. A dunnage bar as defined in claim 1 wherein each of said outer and inner bars is roll-formed from a structural metal.

6. A dunnage bar as defined in claim 1 wherein:

each of said outer bar wall segments is joined to the remainder of said outer bar at a bend; and each of said cross webs engages said outer bar at one of said bends.

7. A dunnage bar as defined in claim 1 wherein:

each of said outer bar wall segments is joined to the remainder of said outer bar at a bend; and each of said cross webs engages said outer bar at one of said bends.

8. A bar for a dunnage rack of the type used in an automotive factory, said bar comprising:

an outer bar generally C-shaped to define a mouth extending along the length of said outer bar, said outer bar being generally rectangular in cross section and including three generally closed sides and a fourth side defining said mouth; and an inner bar fitted within said outer bar, said inner bar including a pair of spaced side webs and a bight web interconnecting said side webs, said bight web engaging the side of said outer bar generally opposite said mouth, said inner bar further including a pair of cross webs extending away from one another and each connected to one of said side webs, each of said cross webs engaging one of said sides of said outer bar, said inner bar further including a pair of spacer webs each connected to and extending away from one of said cross webs, each of said spacer webs engaging said fourth side of said outer bar to space said cross webs from said fourth side.

9. A hanger bar as defined in claim 8 wherein said inner bar is welded to said outer bar.

10. A dunnage bar for a dunnage rack, said dunnage bar comprising:

an outer bar having a generally C-shaped cross section defining a mouth, said outer bar including a closed side opposite said mouth, said outer bar including a pair of wall segments defining said mouth;

a generally T-shaped inner bar fitted within said outer bar, said inner bar including a body portion and a pair of cross webs extending from said body potion, said inner bar engaging said outer bar along at least three separate lines of contact to orthogonally register said inner bar within said outer bar, a first and a second of said lines of contact being between each cross web of said inner bar and each wall segment of said outer bar, a third of said lines of contact being between said body portion of said inner bar and said closed side of said outer bar, whereby the contact between said body portion and said closed side maintains contact between said cross webs and said wall segments, said cross webs of said inner bar spaced from said mouth of said outer bar.

11. A dunnage bar as defined in claim 10 wherein said body portion has two spaced side webs and a bight web interconnecting said side webs, said bight web contacting said closed side of said outer bar opposite said mouth.

12. A dunnage bar as defined in claim 11 wherein said bight web is welded to said outer bar.

13. A dunnage bar as defined in claim 11 wherein each of said cross webs extends from one of said side webs, each of said cross webs including spacer means for spacing said cross webs from said mouth.

14. A dunnage bar as defined in claim 8 wherein said inner bar is welded to said outer bar at selected points of contact between said inner and outer bars.

15. A dunnage bar as defined in claim 10 wherein both of said outer and inner bars are roll-formed of a structural metal.

* * * * *

UNITED STATES PATENT AND TRADEMARK OFFICE

CERTIFICATE OF CORRECTION

PATENT NO. : 5,584,624
DATED : December 17, 1996
INVENTOR(S) : Thomas F. DeVoursney It is certified that error appears in the above-indentified patent and that said Letters Patent is hereby corrected as shown below:

Column 4, Claim 2, Line 43:
"wail" should be --wall--.

Signed and Sealed this

Thirteenth Day of May, 1997

*Attest:*

*Attesting Officer*

BRUCE LEHMAN

*Commissioner of Patents and Trademarks*